US007222598B2

(12) United States Patent
Hayashi

(10) Patent No.: US 7,222,598 B2
(45) Date of Patent: May 29, 2007

(54) VALVE TIMING CONTROLLER

(75) Inventor: Masashi Hayashi, Toyokawa (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/305,165

(22) Filed: Dec. 19, 2005

(65) Prior Publication Data

US 2006/0137635 A1 Jun. 29, 2006

(30) Foreign Application Priority Data

Dec. 28, 2004 (JP) ..... 2004-379125

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,378,475 B2 * 4/2002 Takenaka et al. ..... 123/90.17
6,457,447 B1 * 10/2002 Sato et al. ..... 123/90.17
6,779,500 B2 8/2004 Kanada et al.

FOREIGN PATENT DOCUMENTS

JP 8-121122 5/1996
JP 2001-241306 9/2001

* cited by examiner

*Primary Examiner*—Thomas Denion
*Assistant Examiner*—Zelalem Eshete
(74) *Attorney, Agent, or Firm*—Nixon & Vanderhye PC

(57) ABSTRACT

A vane rotor, a bush, and a press-fitting member are connected with a camshaft of an engine. The bush is supported by an inner surface of a front plate of a shoe housing. The press-fitting member is contact with an end surface of the camshaft. The bush and the press-fitting member are respectively press-fitted into both end surfaces of the vane rotor. Due to a press-fitting force difference between the bush and the press-fitting member, the vane rotor is slightly warped in a press-fitting direction of the bush to rotatably slide on an inner surface of the front plate.

13 Claims, 4 Drawing Sheets

VALVE TIMING CONTROLLER

CROSS REFERENCE TO RELATED APPLICATIONS

This application is based on Japanese Patent Application No. 2004-379125 filed on Dec. 28, 2004, the disclosure of which is incorporated herein by reference.

FIELD OF THE INVENTION

The present invention relates to a valve timing controller that adjusts valve opening/closing timing of an intake valve and/or an exhaust valve of an internal combustion engine.

BACKGROUND OF THE INVENTION

JP-8-121122A shows a valve timing controller that is provided with a housing receiving a driving force from an crankshaft of the engine and a vane rotor accommodated in the housing to transfer the driving force to a camshaft. The vane rotor rotates in advance direction and retard direction to adjust an angle phase of the camshaft relative to the crankshaft. A cylindrical member is press-fitted into the vane rotor on one end surface thereof. The housing includes a front end plate that has a boss rotatably supporting the cylindrical member.

As shown in FIG. 5A, when the cylindrical member 210 is press-fitted into the receiving hole 220 of the vane rotor 200, an inner periphery of the receiving hole 220 is expanded so that the vane rotor 200 is warped in the axial direction as shown by arrows in FIG. 5B. This may causes a leakage of operating fluid between an advance chamber and a retard chamber.

SUMMARY OF THE INVENTION

The present invention is made in view of the foregoing matter and it is an object of the present invention to provide a valve timing controller capable of restricting a warping of the vane rotor.

According to the valve timing controller of the present invention, a press-fitting member and a bush are press-fitted into the vane rotor in its axial direction from opposite side surfaces respectively. Thus, the warping of the vane rotor due to the press-fitting member is cancelled by press-fitting the bush into the vane rotor. A clearance generated between the both sides of vane rotor and the inner surface of the housing is diminished so that the leakage of the operating fluid is reduced to enhance responsiveness of the valve timing controller.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

Embodiments of the present invention will be described hereinafter with reference to the drawings.

(First Embodiment)

Figure 1A:
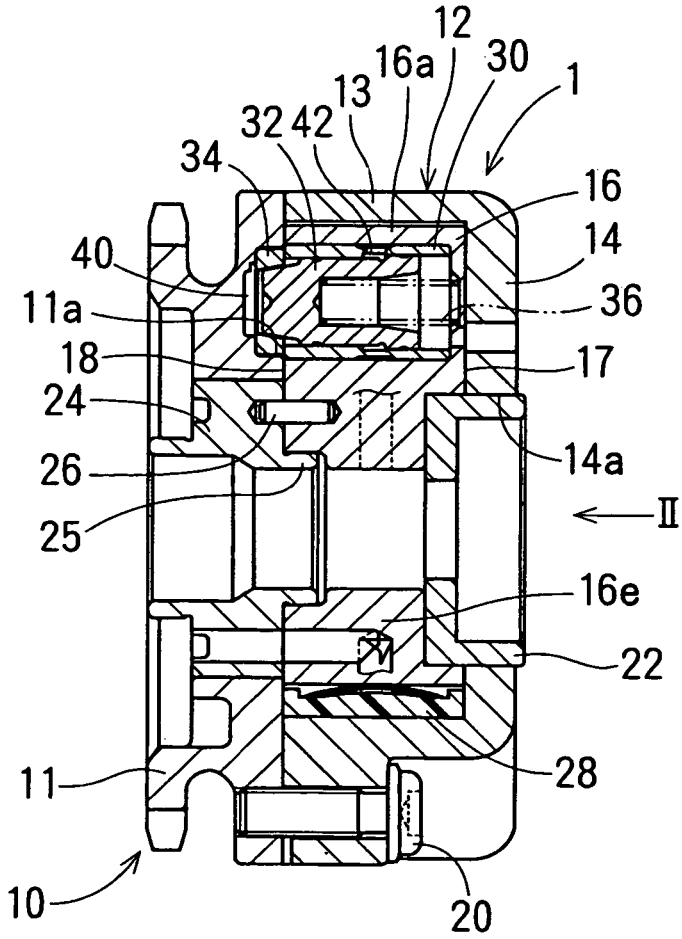
FIG. 1A is a longitudinal sectional view of a valve timing controller according to a first embodiment of the present invention.

FIG. 1A is a cross sectional view of a valve timing controller 1. The valve timing controller 1 is a hydraulic-type controller that utilizes operating oil.

Figure 1B:
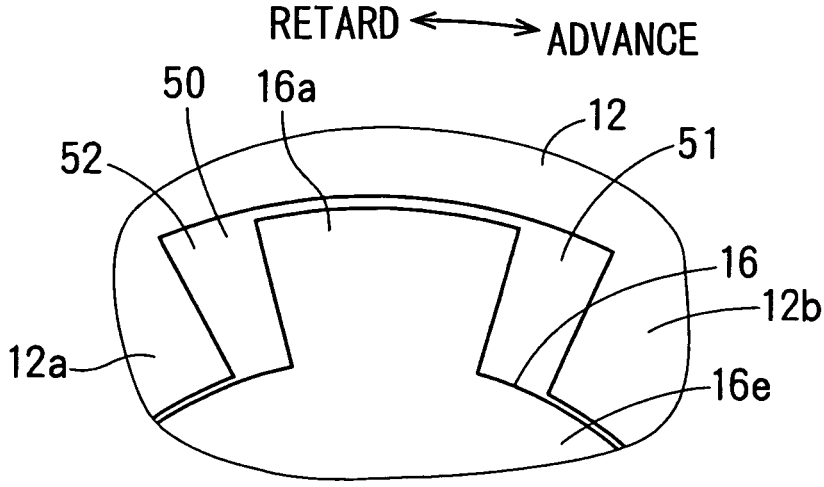
FIG. 1B is a schematic view showing a sector-form-chamber divided into retard and advance chambers by a vane.

A housing is provided with a chain sprocket 11 and a shoe housing 12. The chain sprocket 11 is made of iron alloy and the shoe housing 12 is made of aluminum alloy. The show housing 12 includes four shows (not shown in FIG. 1A), an annular outer wall 13, and a front plate 14 that are integrally formed into one piece. FIG. 1B shows a part of two shoes 12*a* and 12*b*. The front plate 14 is arranged opposite to the chain sprocket 11 across the annular outer wall 13. The front plate 14 corresponds to one sidewall of the housing 10 and the chain sprocket 11 corresponds to the other sidewall of the housing 10. The chain sprocket 11 and the shoe housing 12 are fastened to each other by a bolt 20 on the same axis. The chain sprocket 11 receives a driving force from a crankshaft (not shown) and rotates in synchronization with the crankshaft.

A camshaft (not shown) receives the driving force of the engine through the valve timing controller 1 to open/close the intake vale. The camshaft has a predetermined phase difference relative to the chain sprocket 11.

The vane rotor 16 is made of aluminum alloy. A bush 22 is press-fitted into one end surface 17 of the vane rotor 16. An annular protrusion 25 of a press-fitting member 24 is press-fitted into the other end surface 18 of the vane rotor 16. The other end surface 18 of the vane rotor 16 confronts the chain sprocket 11. A bolt (not shown) fastens the camshaft, the vane rotor 16*m* the bush 22, and the press-fitting member 24 together.

A positioning pin 26 is press-fitted into the vane rotor 16 and the press-fitting member 24 in order to define the relative rotational position between the vane rotor 16 and the press-fitting member 24. The camshaft, the housing 10, and the vane rotor 16 rotates clockwise, viewing along an arrow II in FIG. 1A. This rotating direction is defined as an advance direction of the camshaft relative to the crankshaft hereinafter.

The trapezoidal shoes 12*a*, 12*b* extend inwardly from the annular outer wall 13 and are disposed at regular intervals along the annular outer wall 13. Four sector-form-chambers 50 are defined between four shoes to receive four vanes 16*a* (three of vanes are not shown).

The vane rotor 16 comprises a boss portion 16*e* and four vanes 16*a* that are arranged at regular intervals along the outer surface of the boss portion 16*e*. The vane rotor 16 is accommodated in the housing 10 in such a manner as to rotate relative to the housing 10. Each of vanes 16*a* divides the sector-form-chambers 50 into a retard oil chamber 51 and an advance oil chamber 52. An arrow in FIG. 1B indicates a retard direction and an advance direction of the vane rotor 16 relative to the housing 10.

Figure 2:
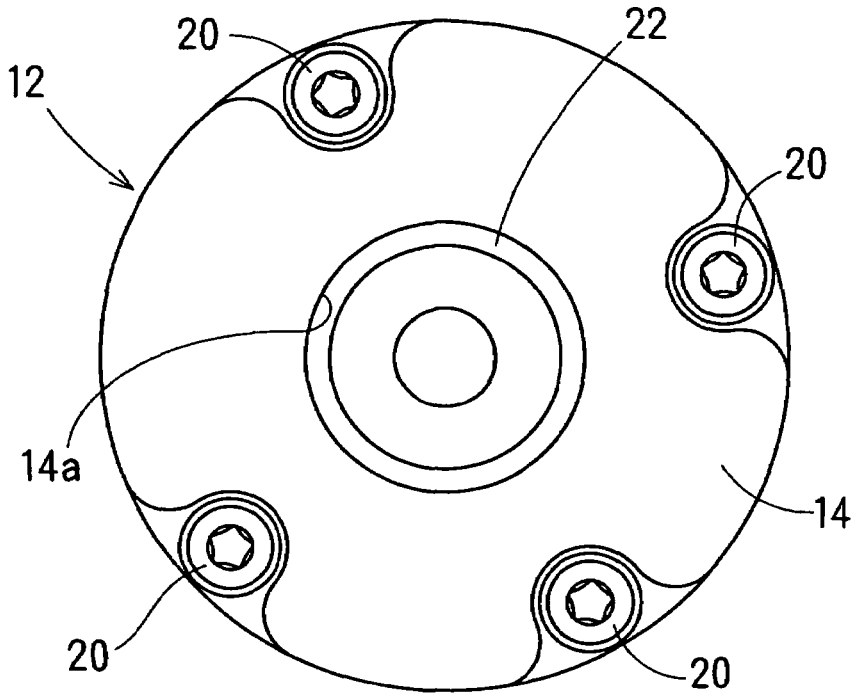
FIG. 2 is a front view of the valve timing controller viewed along an arrow II of FIG. 1.

The bush 22 and the press-fitting member 24 are made of iron alloy and are respectively press-fitted into the end surfaces 17, 18. As shown in FIG. 1A and FIG. 2, the bush 22 is rotatably supported by an inner surface 14*a* of the front plate 14. The press-fitting member 24 is contact with an end surface of the camshaft.

Seal members are provided between the each of the shoes and the boss portion 16*e* and between each of vanes and the inner surface of the annular outer wall 13. The seal members 28 are biased toward each of shoes and the inner surface of the annular outer wall 13 by a spring to restrict a leakage of the operation oil between the retard oil chamber 51 and the advance oil chamber 52.

A cylindrical guide ring 30 is press-fitted into the vane 16*a*. A stopper pin 32 is slidablly inserted into the guide ring 30. A ring 34 is press-fitted in a concave portion 11*a* formed on the chain sprocket 11. The stopper pin 32 can be engaged with the ring 34. The stopper pin 32 and the ring 34 are tapered to be smoothly engaged with each other. A spring 36 biases the stopper pin 32 toward the ring 36. The stopper pin 32, the ring 34, and the spring 36 comprise a mechanism that restricts a relative rotation of the vane rotor 16 relative to the housing 10.

Pressure of oil introduced into an oil pressure chambers 40, 42 biases the stopper pin 32 in a direction in which the stopper pin 32 is disengaged from the ring 34. The oil pressure chamber 40 is communicated with one of the advance oil chamber 52, and the oil chamber 42 is communicated with one of the retard oil chamber 51. One end portion of the stopper pin 32 can be engaged with the ring 34 when the vane rotor 16 is positioned at a predetermined position relative to the housing 10. When the stopper pin 32 is engaged with the ring 34, the rotational position of the vane rotor 16 relative to the housing 10 is fixed.

When the stopper pin 32 is disengaged from the ring 34, the vane rotor 16 is able to rotate in the retard direction and the advance direction, receiving the operation oil into the retard chamber and the advance chamber.

The press-fitted structure of the bush 22 and the press-fitting member 24 to the vane rotor 16 will be described hereinafter.

Figure 3:
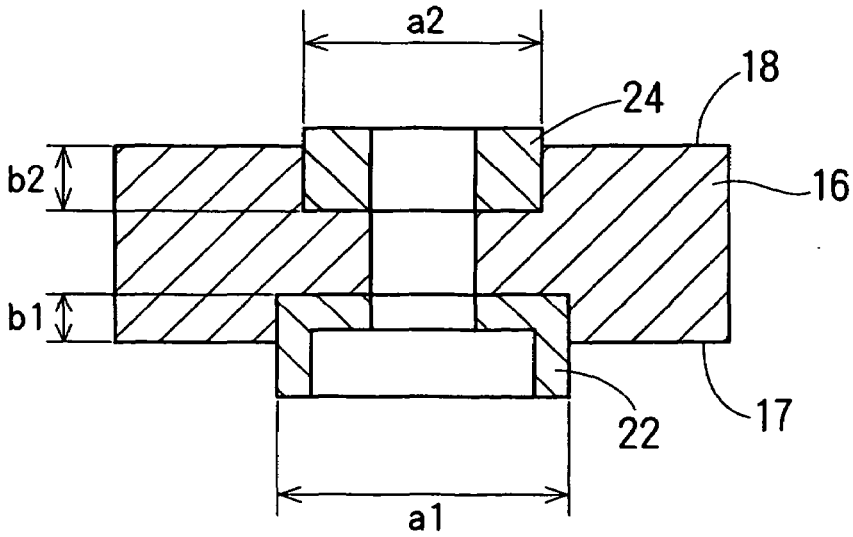
FIG. 3 is a cross sectional view showing an assembly comprised of a vane rotor, a bush, and a press-fitting member.

(1) As shown in FIG. 3, in the case that the outer diameter of the bush 22 is expressed by "a1" and the outer diameter of the press-fitting member 22 is expressed by "a2", "a1" is lager than "a2".

$$a1>a2$$

(2) In the case that press-fitting depth of the bush 22 is expressed by "b1" and press-fitting depth of the press-fitting member 24 is expressed by "b2", "b2" is larger than "b1".

$$b1<b2$$

Figure 4A:
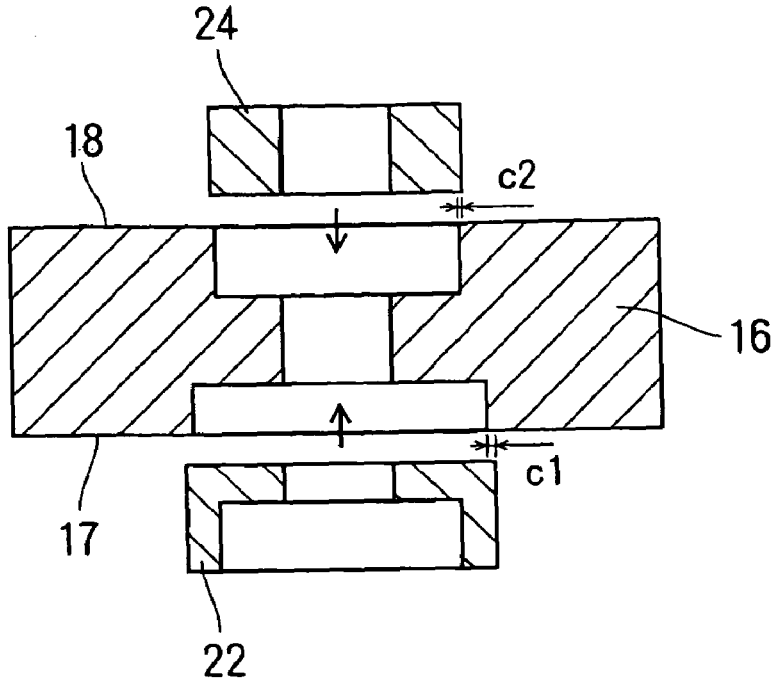
FIG. 4A is a cross sectional view showing a situation before a bush and a press-fitting member are press-fitted into the vane rotor.

(3) As shown in FIG. 4A, radial press-fitting amount of the vane rotor 16 is expressed by "c1" and the radial press-fitting amount of the press-fitting member 24 is expressed by "c2", "c1" is larger than "c2".

$$c1>c2$$

(4) The bush 22 is made of iron alloy of which hardness is greater than that of the press-fitting member 24.

Figure 4B:
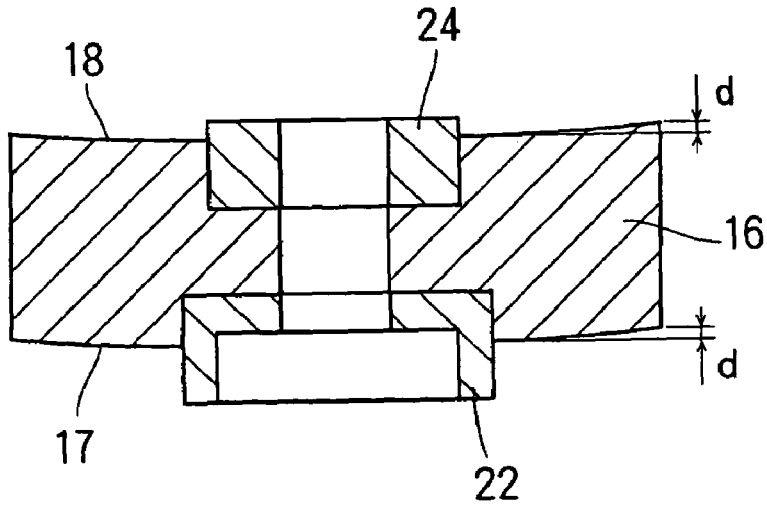
FIG. 4B is a cross sectional view showing a situation after the bush and the press-fitting member are press-fitted into the vane rotor.
Figure 5A:
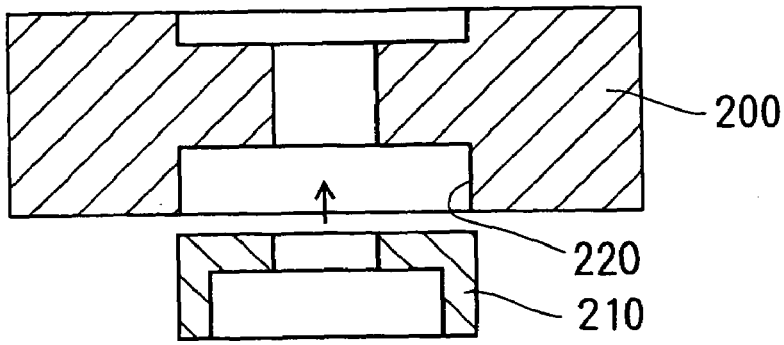
FIG. 5A PRIOR ART
FIG. 5A is a cross sectional view showing a situation before a bush is press-fitted into the vane rotor.
Figure 5B:
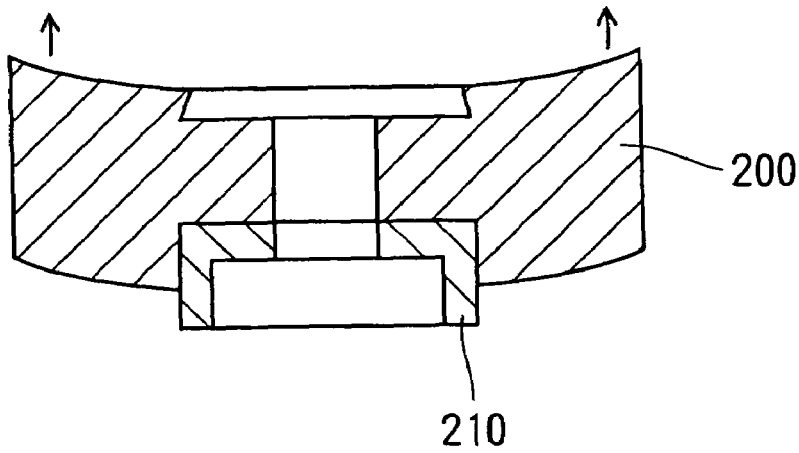
FIG. 5B PRIOR ART
FIG. 5B is a cross sectional view showing a situation after the is press-fitted into the vane rotor.

According to the above four conditions (1)–(4), the warping amount of vane rotor 16 in the case where the bush 22 is press-fitted into the vane rotor 16 is larger than that of vane rotor 16 in the case where the press-fitting member 24 is press-fitted into the vane rotor 16. Thus, when the bush 22 and the press-fitting member 24 are press-fitted into the vane rotor 16, the vane rotor 16 warps in a direction that the bush 22 is press-fitted as shown in FIG. 4B. The end surface 17 of the vane rotor 16 is convex and the other end surface 18 of the vane rotor 16 is concaved. The warping directions of the vane rotor 16 are quite different from each other between when the bush 22 is press-fitted and when the press-fitting member 24 is press-fitted. The warping amount "d" of the vane rotor 16 in its axial direction is reduced rather than the case where only the bush 22 is press-fitted as shown in FIG. 5B.

The sliding clearances between the end surfaces 17, 18, the inner surface of the chain sprocket 11 and the inner surface of the front plate 14 are reduced. Thus, oil leakage between the retard chamber and the advance chamber through the sliding clearances are restricted, so that the responsiveness of the valve timing controller is improved.

Since the oil leakage is restricted, total amount of operating oil can be reduced so that the size of the oil pump can be reduced.

Since the end surface 17 of the vane rotor 16 is convex relative to the front end plate 14 made of aluminum alloy, a sliding contact area between the end surface 17 and the front plate 14 is decreased so that the end surface 17 of the vane rotor 16 is hardly adhered to the inner surface of the front plate 14.

(Alternative Embodiment)

In the first embodiment, four conditions (1)–(4) are established. Alternatively, at least one of four conditions can be established.

The shoe housing 12 and the vane rotor 16 can be made of different material respectively. The end surface 18 of the vane rotor 16 can be made convex instead of the end surface 17. The annular outer wall 13 and the front plate 14 can be made independently.

In the first embodiment, driving force of the crankshaft is transmitted to the camshaft through the chain sprocket. Alternatively, a timing pulley or a timing gear can be used.

The stopper pin 32 can be structured is such a manner as to radially move to engage the ring 34. Alternatively, the stopper pin 32, the ring 34, and the spring 36 can be omitted.

What is claimed is:

1. A valve timing controller provided in a driving force transferring system that transfer a driving force of a driving shaft of an internal combustion engine to a driven shaft for opening/closing at least one of an intake valve and an exhaust valve, comprising:

a housing rotating with one of the driving shaft and the driven shaft, the housing forming a chamber therein;

a vane rotor rotating with the other one of the diving shaft and the driven shaft, the vane rotor having a vane that is accommodated in the chamber to divide the chamber into a retard chamber and an advance chamber, the vane rotor enabled to rotate in a retard direction and an advance direction relative to the housing by a pressure in the retard chamber and the advance chamber;

a bush press-fitted into one end surface of the vane rotor in an axial direction, the bush supported by one axial sidewall of the housing; and a press-fitting member press-fitted into the other end surface of the vane rotor in the axial direction, wherein the press-fitting member is disposed between said other end surface of the vane rotor and an end surface of one of said driving shaft and said driven shaft.

2. A valve timing controller according to claim 1, wherein the one axial sidewall of the housing and the vane rotor are made of aluminum alloy.

3. A valve timing controller according to claim 1, wherein an outer diameter of the bush is larger than that of the press-fitting member.

4. A valve timing controller according to claim 1, wherein a press-fitting depth of the bush is shallower than that of the press-fitting member.

5. A valve timing controller according to claim 1, wherein the bush has hardness that is greater than that of the press-fitting member.

6. A valve timing controller according to claim 1, wherein a radial press-fitting amount of the bush is greater than that of the press-fitting member.

7. A valve timing controller according to claim 2, wherein a radial press-fitting amount of the bush is greater than that of the press-fitting member.

8. A valve timing controller provided in a driving force transferring system that transfer a driving force of a driving shaft of an internal combustion engine to a driven shaft for opening/closing at least one of an intake valve and an exhaust valve, comprising:

a housing rotating with one of the driving shaft and the driven shaft, the housing forming a chamber therein;

a vane rotor rotating with the other one of the diving shaft and the driven shaft, the vane rotor having a vane that is accommodated in the chamber to divide the chamber into a retard chamber and an advance chamber, the vane rotor enabled to rotate in a retard direction and an advance direction relative to the housing by a pressure in the retard chamber and the advance chamber;

a bush press-fitted into one end surface of the vane rotor in an axial direction, the bush supported by one axial sidewall of the housing; and a press-fitting member press-fitted into the other end surface of the vane rotor in the axial direction, wherein the one axial sidewall of the housing and the vane rotor are made of same material to each other, the other axial sidewall of the housing and the vane rotor are made of different material from each other, and the one end surface of the vane rotor is convex to rotatably slide on an inner surface of the one axial sidewall of the housing.

9. A valve timing controller according to claim 8, wherein the one axial sidewall of the housing and the vane rotor are made of aluminum alloy.

10. A valve timing controller according to claim 8, wherein an outer diameter of the bush is larger than that of the press-fitting member.

11. A valve timing controller according to claim 8, wherein a press-fitting depth of the bush is shallower than that of the press-fitting member.

12. A valve timing controller according to claim 8, wherein the bush has hardness that is greater than that of the press-fitting member.

13. A valve timing controller according to claim 8, wherein a radial press-fitting amount of the bush is greater than that of the press-fitting member.

* * * * *